US008595987B2

(12) United States Patent
Curry, III

(10) Patent No.: US 8,595,987 B2
(45) Date of Patent: Dec. 3, 2013

(54) ROLL-OUT STRUCTURE/HURRICANE SHEATHING

(75) Inventor: James Curry, III, Massapequa, NY (US)

(73) Assignee: Ledgetech Holdings, LLC, Fort Meyers, FL (US)

( * ) Notice: Subject to any disclaimer, the term of this patent is extended or adjusted under 35 U.S.C. 154(b) by 168 days.

(21) Appl. No.: 11/412,609

(22) Filed: Apr. 27, 2006

(65) Prior Publication Data

US 2007/0272373 A1 Nov. 29, 2007

(51) Int. Cl.
*E04B 1/346* (2006.01)

(52) U.S. Cl.
USPC ..... 52/71; 52/592.1

(58) Field of Classification Search
USPC ..... 52/71, 223.7, 384, 388, 586.1, 177, 52/592.1, 582.1; 404/35, 41, 47; 160/230, 160/235, 237
See application file for complete search history.

(56) References Cited

U.S. PATENT DOCUMENTS

| | | | | |
|---|---|---|---|---|
| 451,437 | A * | 4/1891 | Recker | 160/230 |
| 1,110,219 | A * | 9/1914 | Metzger | 160/231.1 |
| 3,537,223 | A | 11/1970 | Lerchenthal | |
| 3,611,655 | A | 10/1971 | Loebner | |
| 4,088,805 | A | 5/1978 | Wiegand | |
| 4,277,201 | A | 7/1981 | Abell | |
| 4,329,739 | A * | 5/1982 | Loebner | 362/153 |
| 4,428,791 | A | 1/1984 | Reinke | |
| 5,219,635 | A | 6/1993 | Weiter et al. | |
| 5,345,738 | A | 9/1994 | Dimakis | |
| 5,419,386 | A | 5/1995 | Magro et al. | |
| 6,017,830 | A | 1/2000 | Brown et al. | |
| 6,041,846 | A | 3/2000 | Langlois | |
| 6,113,176 | A * | 9/2000 | Bernardo | 296/100.01 |
| 6,470,811 | B1 * | 10/2002 | Isinger | 108/153.1 |
| 6,474,029 | B1 | 11/2002 | Cook et al. | |
| 6,699,575 | B1 | 3/2004 | Dagher et al. | |
| 6,715,249 | B2 | 4/2004 | Rusek et al. | |
| 6,769,218 | B2 | 8/2004 | Pervan | |

(Continued)

FOREIGN PATENT DOCUMENTS

WO WO 2007/133359 A2 11/2007

OTHER PUBLICATIONS

International Search Report for Application No. PCT/US2010/039916 dated Jan. 20, 2011.

*Primary Examiner* — Christine T Cajilig
(74) *Attorney, Agent, or Firm* — Scully, Scott, Murphy & Presser, P.C.

(57) ABSTRACT

A roll-out sheet of construction material has a plurality of slats, each with a shelf with a generally upward facing surface and a ledge with a generally downwardly facing surface. The plurality of slats are adjacent one another so that the ledge of one slat overlies the shelf of an adjacent slat. A load-bearing flexible film is secured to the plurality of slats on one side, the opposite sides of the slats from the flexible film are free allowing the slats to articulate relative to one another. The slats may have a longitudinal opening at least partially through, which is optionally filled with thermal and/or sound insulation, and/or load-bearing filler. The openings can also include a rib or support extending across the opening and bracing one side wall of the slat against the other. A securing tab can extend outward from one or more slats, shaped as a hoop, or having a through opening. When deployed, the roll-out sheet may be flat or have some angle or curvature.

16 Claims, 7 Drawing Sheets

(56) References Cited

U.S. PATENT DOCUMENTS

| | | | | |
|---|---|---|---|---|
| 6,786,013 | B2 | 9/2004 | Coulton | |
| 6,931,809 | B1 | 8/2005 | Brown et al. | |
| 7,090,430 | B1 | 8/2006 | Fletcher et al. | |
| 2004/0010983 | A1* | 1/2004 | Eshpar | 52/71 |
| 2005/0063780 | A1* | 3/2005 | Thorne | 404/41 |

* cited by examiner 100
120
120
120
150
132
158
152
154
156
124
12a

ROLL-OUT STRUCTURE/HURRICANE SHEATHING

BACKGROUND OF THE INVENTION

1. Field of Invention

The present invention relates to the field of building materials, and more particularly to a roll-out building material with load bearing capability.

2. Description of Related Art

In the construction of building structures, plywood sheets, generally in standard units of 4' by 8' dimension, is often used to cover and enclose the inner structure of walls and roofs, an optionally provide a base of attaching outer finishing materials (e.g., siding or roofing shingles, respectively). The use of plywood has several drawbacks.

Plywood is a natural material, and subject to deterioration over time and exposure to elements. This often necessitates the application of protective sheathing over the plywood as a barrier against moisture, for example. This extra step increases building costs in time and materials. Therefore, a superior barrier sheeting to plywood is desirable.

Further, the process of covering a building frame of any significant size with plywood sheets is time-consuming. Without extraordinary numbers of workers, the process can take several days to complete. During this time, the frame may be exposed to the elements, including rain, which is detrimental to wood frame members. To address this, the frames are typically covered with a house wrap material, for example made of TYVEK, to protect the frame until the plywood process is complete. However, if the frame can be covered in less time than by plywood, without exposing the framing to the adverse elements for extended periods, the expense of applying the house wrap, both in time and materials, can be saved. Therefore, a sheeting material that can be applied rapidly is desirable.

Moreover, plywood of useable dimensions must be manufactured from trees of a particular age, and rapid re-growth of usable trees is difficult, if not impractical. Therefore, a sheeting material having similar structural properties of plywood sheets, yet manufactured of a man-made and readily available materials would be desirable.

Further, in certain areas prone to extreme weather (hurricanes, tornadoes, etc.), extreme low air pressures typical of such weather disturbances can be destructive of buildings constructed by securing plywood to the framing by nails alone, as is the common practice. Additional securing measures are desirable, but cumbersome as applied to plywood construction. Therefore, a building material which can be more easily secured against damage by extreme weather conditions would be desirable.

BRIEF SUMMARY OF THE INVENTION

Therefore, in order to address these and other deficiencies in the prior art, provided according to the present invention is a roll-out sheet of construction material having a plurality of slats. Each slat includes a shelf with a generally upward facing surface and a ledge with a generally downwardly facing surface. The plurality of slats are adjacent one another so that the ledge of one slat overlies the shelf of an adjacent slat. A load-bearing flexible film is secured to the plurality of slats on one side, the opposite sides of the slats from the flexible film are free allowing the slats to articulate relative to one another.

Preferably, multiple slats making up a roll-out sheet include those are arranged end to end, with the junction of two slats arranged at an intermediate point along the length of a laterally adjacent slat. The slats may have a longitudinal opening at least partially through, which is optionally filled with thermal and/or sound insulation, and/or a load-bearing filler Slats having openings can also include a rib or support extending across the opening and bracing one side wall of the slat against the other. The rib or support is a support, can be integrally formed with one side wall and bracing against the opposite side wall. A securing tab can extend outward from one or more slats, shaped as a hoop, or having a through opening. When deployed, the roll-out sheet may be flat or have some angle or curvature.

BRIEF DESCRIPTION OF THE DRAWINGS

These and other features, benefits and advantages of the present invention will be made apparent with reference to the following detailed description and accompanying figures, where like reference numerals refer to like structures across the several views, and wherein.

DETAILED DESCRIPTION OF THE INVENTION

Figure 1:
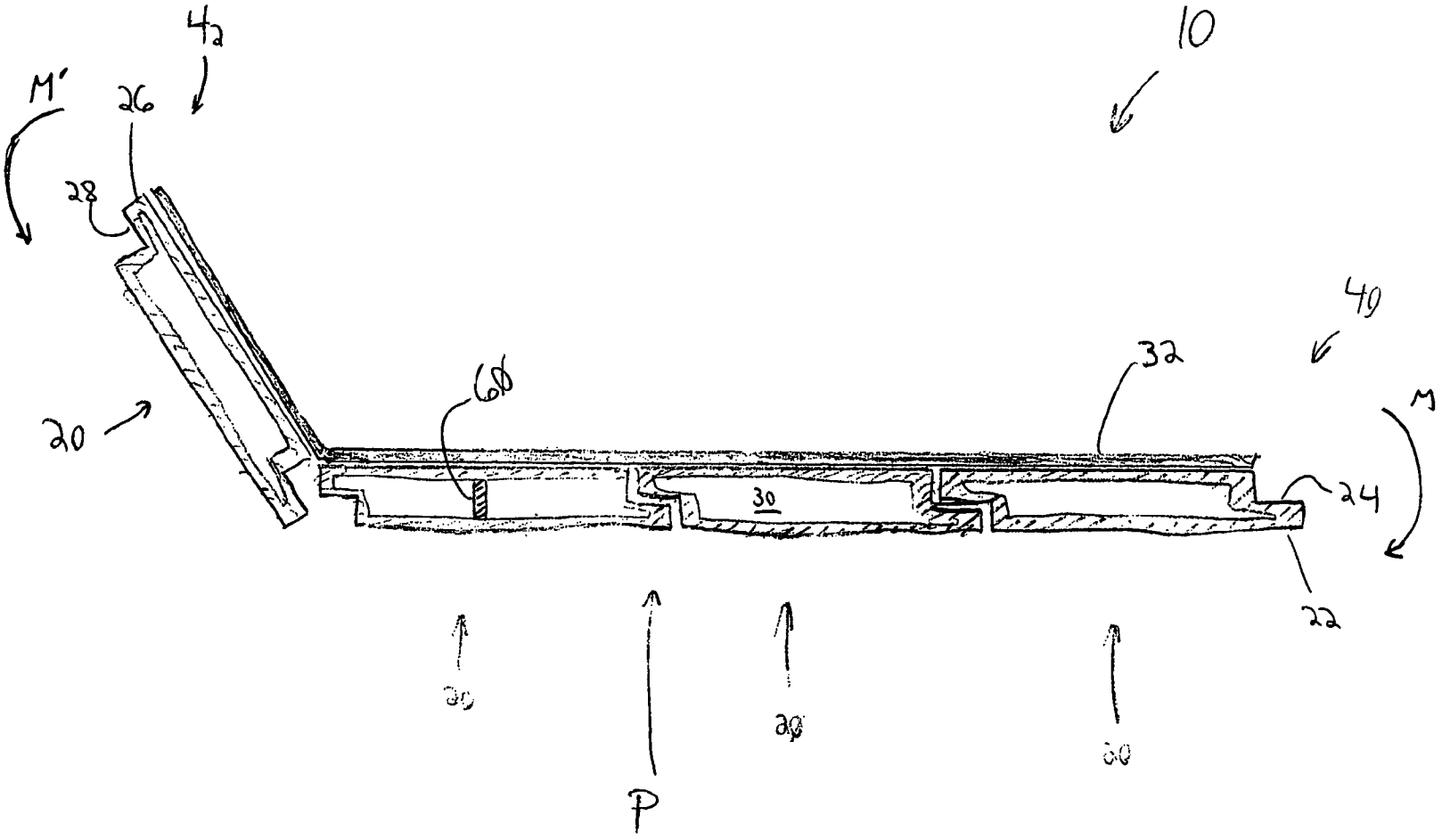
FIG. 1 illustrates a side end view of a roll-out sheet of building material according to a first embodiment of the present invention.

Referring now to FIG. 1, illustrated is a side end view of a roll-out sheet, generally 10, according to a first embodiment of the present invention. Roll-out sheet 10 comprises a plurality of transverse slats 20. Transverse slats 20 preferably have identical cross-sections to one another throughout the roll-out sheet 10. Each slat 20 has at one end a shelf 22 including a generally upward facing surface 24. A ledge 26 is at an opposite end from the shelf 22, the ledge 26 including a generally downwardly facing surface 28. The surfaces 24 and 28 may be parallel with the outer walls of the slat 20, as illustrated in FIG. 1, as one arrangement among others that yields a flat roll-out sheet 10. Alternately, some or all of the surfaces 24, 28 may be concave or convex, or angled relative to the outer wall of the slat 20 or to each other, which allows for the roll-out sheet 10 to be other than flat when deployed. In this and other figures, clearances are exaggerated to show the parts of the present invention, and the figures should not be interpreted as being to scale.

Slats 20 may be of solid cross-section, for example if manufactured of wood, plastic, or metal. Alternately, the slats may have an opening 30 longitudinally through the slat 20. Such slats 20 having an opening 30 may be produced by extrusion of metal or plastic, or bent metal sheet, for example. Opening 30 may be advantageously filled with another material, for example one or more of foam or fiberglass, as insulation against transfer of heat and/or sound.

Slats 20 are positioned adjacent one another with the downwardly facing surface 28 of the ledge 26 on one slat opposing the upwardly facing surface 24 of the shelf 22 on an adjacent slat. So positioned, on one side of the slats 20 a flexible film 32 is secured to the plurality of slats, for example by adhesive bonding. The film 32 is load-bearing against shear stresses in the plane of the film 32. As an example only, film 32 is a material known in the construction trade as biaxial nylon, which is impregnated with strands along two intersecting and perpendicular directions to improve load bearing strength.

In an alternate embodiment, the flexible film 32 and/or slats 20 may include KEVLAR material, for protection against penetration while remaining lightweight. More preferably, the flexible film material can have properties of self-sealing against punctures, for example as exhibited in the material sold under the trade name ICE AND WATER SHIELD® by Grace Construction Products. Therefore, when used for example as roofing material, the roll-out sheet 10 can be secured to the framing by conventional roofing nails, and the surface of the roof would have an intact barrier, obviating the need to apply an additional barrier layer, as with more conventional construction techniques.

Moreover, in a preferred embodiment, the flexible film material presents an enhanced-friction exterior surface, preferably at least comparable to conventional plywood. At a minimum, the enhanced-friction exterior surface will enable a worker to obtain secure footing while wearing conventional footwear, notwithstanding the slope of a roof that is conventional in residential or other types of construction. The enhanced-friction exterior surface can be provided by one or more of roughing the exterior surface of the flexible film material, providing protrusions above the surface of the flexible film, or by adhesion or implantation of friction-enhancement, whether chemical adhesive material, granular material, or otherwise. In certain further embodiments, the exterior surface of the flexible film material may itself comprise a roofing or siding material that would otherwise have been applied to a plywood surface using conventional construction techniques.

As described, roll-out sheet 10 is flexible, so that slats 20 are able to deflect to the film side of the roll-out sheet 10 to allow roll-out sheet 10 to be reconfigured in a more compact format, for example folded over itself one or more times, or, more preferably, rolled into a generally cylindrical shape. However, in the unrolled configuration, roll-out sheet 10 supported at ends 40, 42, can support an intermediate load P, and/or beam bending moment couple M-M'.

Figure 1A:
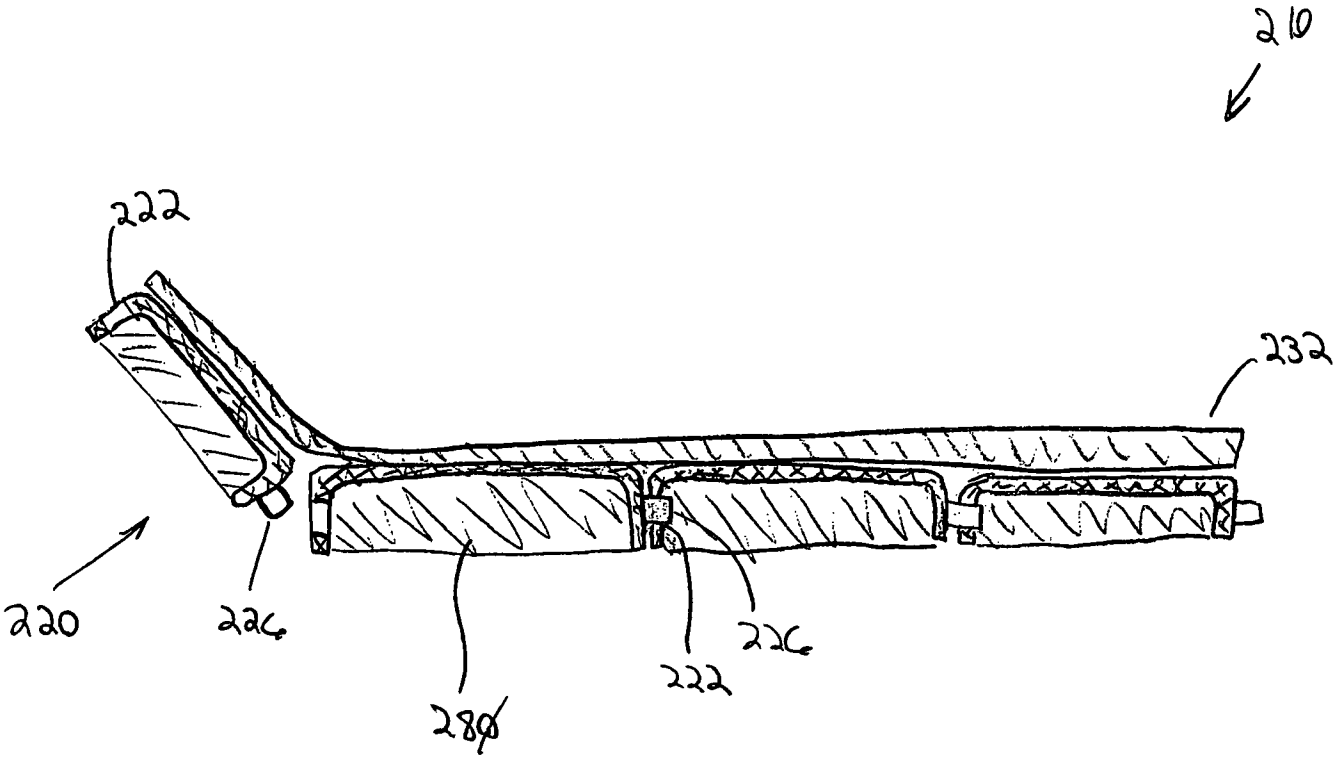
FIG. 1(A) illustrates a second embodiment of a roll-out sheet of building material in cross-sectional view.

Referring now to FIG. 1(A), an alternate embodiment of a roll-out sheet 210 is illustrated in cross-sectional view. While generally similar to the embodiment of FIG. 1, slats 220 of this embodiment lack the shelf or ledge as in the previous embodiment. In this embodiment, adjacent slats engage one another through a system of corresponding holes 222 and pins 226. As adjacent slats 220, connected with one another by flexible film 232 pivot into engagement with one another, pins 226 project into holes 222, thereby providing vertical stability among the slats 220. Through holes 222 are provided where the material of the slat is thinner than the length of the pin 226. In other cases, however, the pins 222 may be received in a recess in the adjacent slat 220.

In this or other embodiments, additional through holes, 228 (shown in FIG. 2) can be provided in one or more slats 20 or 220, preferably axially aligned among the plural slats 20 or 220, for accommodating a securing line 230, such as a cable, chain, cord and so on. Applying tension to the securing line 230 and connecting the securing line to at least two slats will compress the slats against one another and provide increased rigidity to the roll-out sheet in the unrolled configuration. Tension may be applied by a turnbuckle, a threaded nut on at least one end of the securing line, or other means which will be apparent to those skilled in the art.

Also illustrated in FIG. 1(A), but generally applicable to other embodiments, slats 220 are open to the side opposite flexible film 232. In this embodiment, the slats are filled with a foam insulation material 280. However, the slats 220 need not be closed on all sides, whether completely or partially, if the demands of the application do not require it. Accordingly, the entire roll-out sheet 210 may be lighter and less expensive for the reduction in material.

Figure 1B:
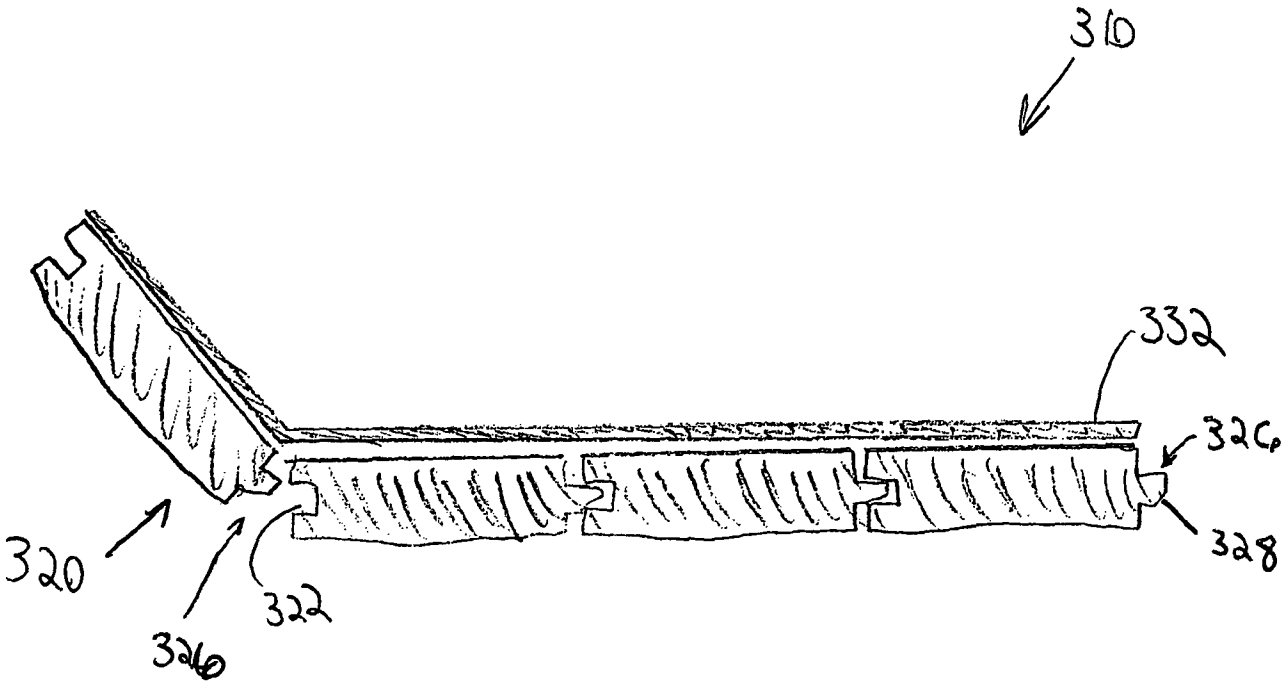
FIG. 1(B) illustrates a third embodiment of a roll-out sheet of building material in cross-sectional view.

Referring now to FIG. 1(B), yet another embodiment of a roll-out sheet 310 is illustrated in cross-section. This embodiment is characterized by the accommodation of tongues 326 on one side of slats 320 into grooves 322 on an opposite side of the adjacent slat 320. Tongue 326 may be provided with a relief 328 to accommodate angular articulation of one slat relative to another. It will be appreciated by one skilled in the art in light of the instant disclosure to function in a similar manner as the foregoing embodiments.

Figure 2:
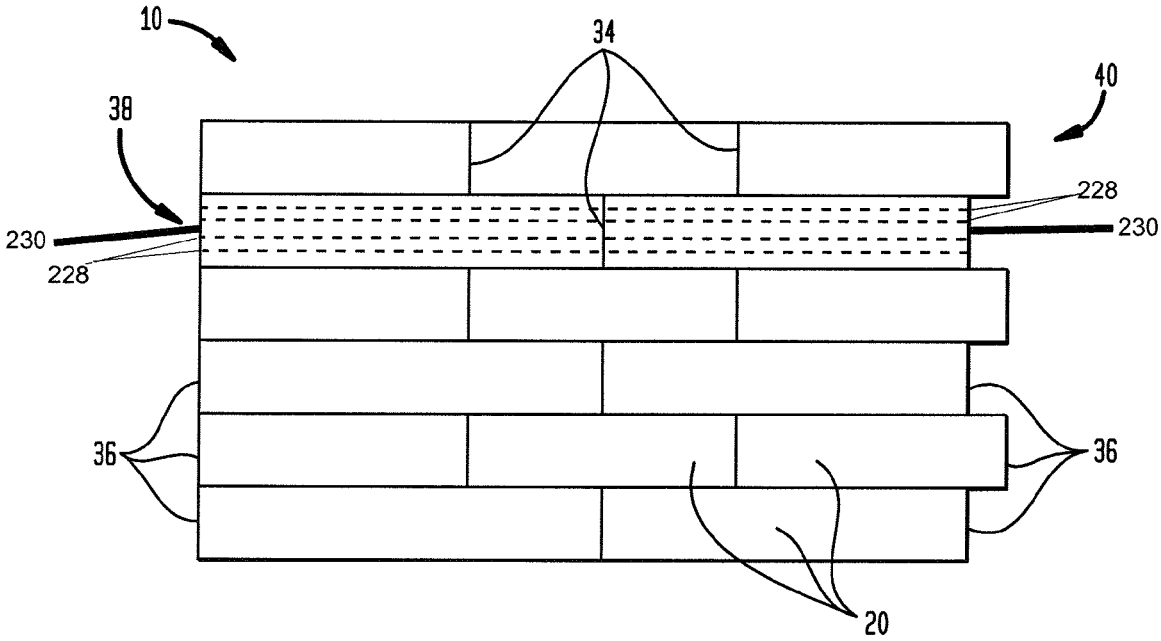
FIG. 2 illustrates a bottom view of the roll-out sheet according to a further embodiment of the present invention.

Referring now to FIG. 2, illustrated is a bottom view of the roll-out sheet 10 according to a further embodiment of the present invention. In certain embodiments, the slats 20 may extend the complete width of the roll-out sheet 10. However, as illustrated in FIG. 2, slats 20 may be shorter than the width of the roll-out sheet 10. Therefore, roll-out sheet 10 may be nearly any conceivable width, without limitation by the practical length of slats 20. In the embodiment of FIG. 2, the slats 20 are arranged in a so-called running bond, whereby the end-to-end junctions 34 of two horizontally adjacent slats 20 is positioned at an intermediate point along the length of a vertically adjacent slat 20. Accordingly, the end-to-end junctions 34 of slats 20 is supported by adjacent slats 20, and the roll-out sheet 10 is more resilient against beam bending loads in the longitudinal direction of the slats 20, i.e., transverse to the moment couple M-M' of FIG. 1.

According to one embodiment, the ends 36 of the slats 20 can present a straight edge 38 of roll-out sheet 10. Alternatively, the ends 36 of roll-out sheet 10 present a castellated edge 40. In the latter case, two laterally adjacent roll-out sheets with castellated edges may be intermeshed with one another, or alternatively they may be joined by a complementary filler joint, which may be adapted to join two sheets in one instance, or to cap an end to present a flush edge in others.

Moreover, because the roll-out sheet 10 can be conceivably any practical dimensions, building contractors are not limited to the standard 4'×8' unit size of plywood for the same of manageability by the workers doing the installation. Roll-out sheets 10 can be fabricated to specification, or even cut to length on-site with a simple utility knife, within the limitations of the flexible film 32. Accordingly, installation is faster than plywood mounting, requiring less manpower and less total man-hours than comparable plywood construction. Advantages over alternate construction techniques are similarly realized.

Figure 3:
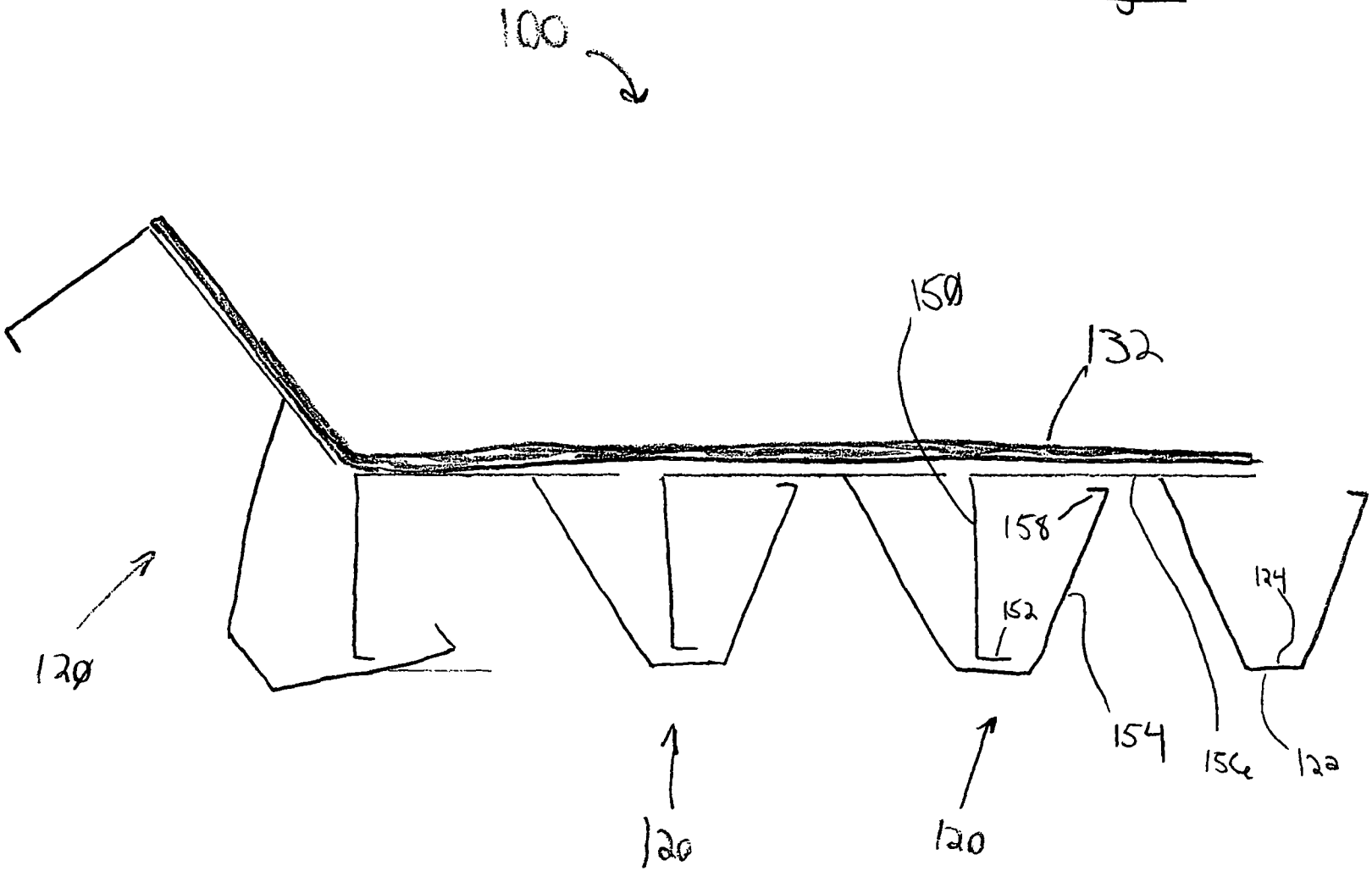
FIG. 3 illustrates a roll-out sheet according to a second embodiment of the present invention.

Referring now to FIG. 3, illustrated is a roll-out sheet, generally 110, according to a second embodiment of the present invention. Features of the roll-out sheet 100 common with the first embodiment will be generally dispensed with. In the second embodiment, roll-out sheet 110 has slats 120 that lend themselves to formation by a sheet metal bending process, although extrusion, rolling or other processes are applicable as well. A flexible film 132 is secured to the plurality of slats 120.

Slats 120 have a first shelf 122 with a generally upwardly facing surface 124 at one end of the slat 120, and a leg 150 at an opposite end of slat 120 from the shelf 122. As arranged in the roll-out sheet 110, leg 150 is in contact with shelf 122, and limits the movement of the adjacent slat 120. In more preferred embodiments, leg 150 includes a tab 152 that rests generally parallel with surface 124 in order to distribute forces by contact of leg 150 with shelf 122. Similarly, in more preferred embodiments, a portion of the slat 120 on an opposite side from the leg 150 includes an upwardly directed portion 154 in contact with an underside surface 156 of an adjacent slat 120. Upwardly directed portion 154 preferably includes a tab 158 generally parallel with underside surface 156 in order to distribute contact forces.

Figure 4:
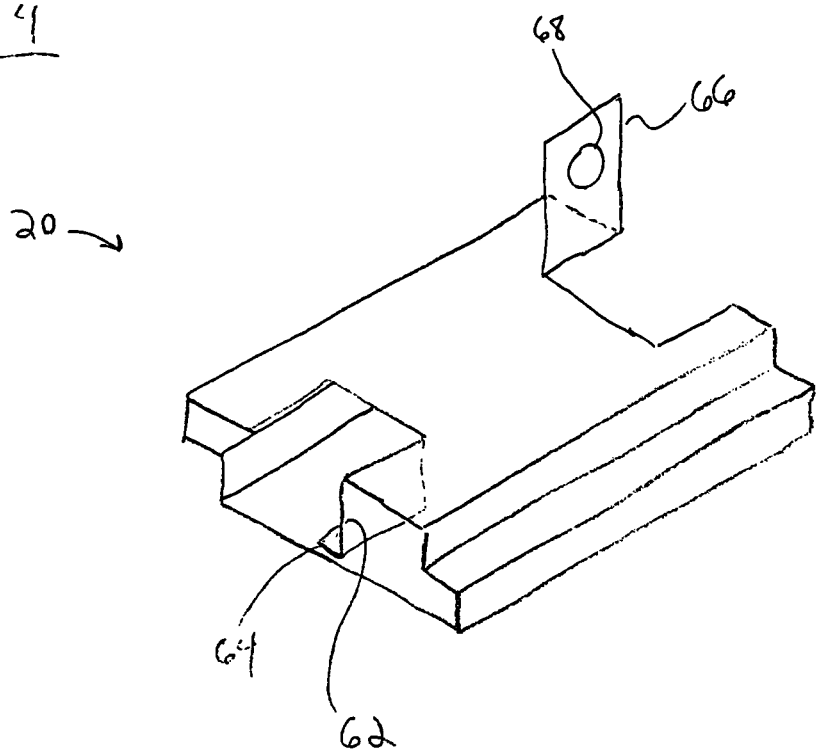
FIG. 4 illustrates a perspective view of an alternate embodiment generally similar to the embodiment of FIG. 1.

Referring now to FIG. 4, illustrated is a perspective view of an alternate embodiment generally similar to the embodiment of FIG. 1. The slat 20 of FIG. 4 can be considered formed from a sheet material in which additional structural features can be punched from the walls of the slat 20. FIG. 1 illustrates that slats 20 may be reinforced by providing one or more longitudinal ribs 60 within opening 30. Lateral ribs can be provided alternately or additionally. Ribs may be straight, as illustrated, or formed at any angle, and be present singly or a plurality, for example in the form of corrugation. Alternately, fill material may be load bearing.

Either ribs 60 or supports 62, typically shorter in length than ribs 60, may be formed from the material of slat 20 itself, and deflected inward to support against the opposing wall of the slat 20, as illustrated in FIG. 4. Alternately the can be provided without removing or deflecting material from the wall of the slat 20. Supports 62 or ribs 60 may further include a tab 64 generally parallel to the opposing wall of the slat 20, in order to distribute contact forces.

Slat 20 as shown in FIG. 4 also includes a securing tab 66 extending outward from the wall of the slat 20. Securing tab 66, includes a through opening 68, which may be surrounded by the securing tab 66 as shown, which or may extend to an edge of the securing tab 66. Alternately, securing tab 66 may be formed as a hook. A securing line, e.g., a cable, chain, cord, etc., may be passed through the through opening 68 of one or more slats 20, and secured to a remote position, e.g., the foundation of the building, in order to help retain the roll out sheet 10 against displacement by adverse weather conditions.

Alternately or additionally, a securing line and one or more complementary through openings 68 may be provided internally to the slats 20 of roll-out sheet 10. The securing line may be inserted through the through openings of one or more slats 20 and one or more roll-out sheets 10. Moreover, applying tension to the securing line and connecting the securing line to at least two slats 20 of the roll-out sheet 10 will compress the slats 20 against one another and give increased rigidity to the roll-out sheet 10 in the unrolled configuration. Tension may be applied by turnbuckle, threaded nut on at least one end of the securing line, or other means which will be apparent to those skilled in the art in light of the instant disclosure. This embodiment of tensioning a securing line within the roll-out sheet 10 to increase rigidity is particularly applicable to the free-standing embodiments, described, infra.

In FIG. 4, an abbreviated length of slat 20 is illustrated to more clearly show support 62 and tab 66. However, either or both of support 62 and tab 66 are more preferably located along the longitudinal length of slat 20, rather than at an end thereof.

Figure 5:
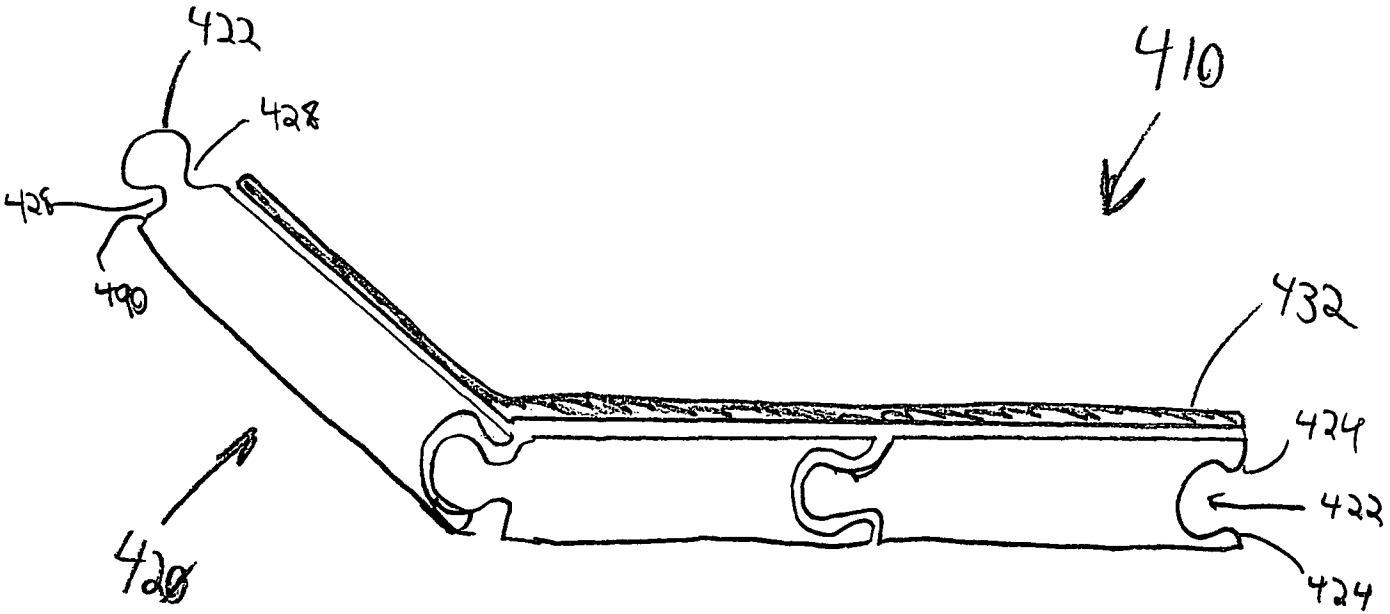
FIG. 5 illustrates a fourth embodiment of a roll-out sheet of building material in cross-sectional view.

Referring now to FIG. 5, yet another embodiment of a roll-out sheet 410 is illustrated in cross-section. This embodiment is characterized by a rounded projection 422 on one side of the slats 420. Projection 422 is received in a corresponding socket 426 of an adjacent slat 420. Projection 422 has recesses 428 inward of the projection 422 for receiving the ends 424 of socket 422. Moreover, on a lower side of the projection 422, opposite the flexible film 432, a stop 490 limits the articulation of the slat 420. With sufficient resiliency of ends 424, flexible film 432 may be eliminated in this embodiment. It will be appreciated by one skilled in the art in light of the instant disclosure to function in a similar manner as the foregoing embodiments.

As described, the roll-out sheet is contemplated as a building material, particularly a replacement for plywood sheeting used in covering the frames walls and/or roofs. However, the invention is not limited to that application, has myriad other uses. For example, load-bearing sheets can be used a decking material, as a replacement for individual planks typically used in that application. The material can be used to bridge open spans, ranging from the size of a footbridge or smaller to that of a vehicle crossing or greater.

Figure 6:
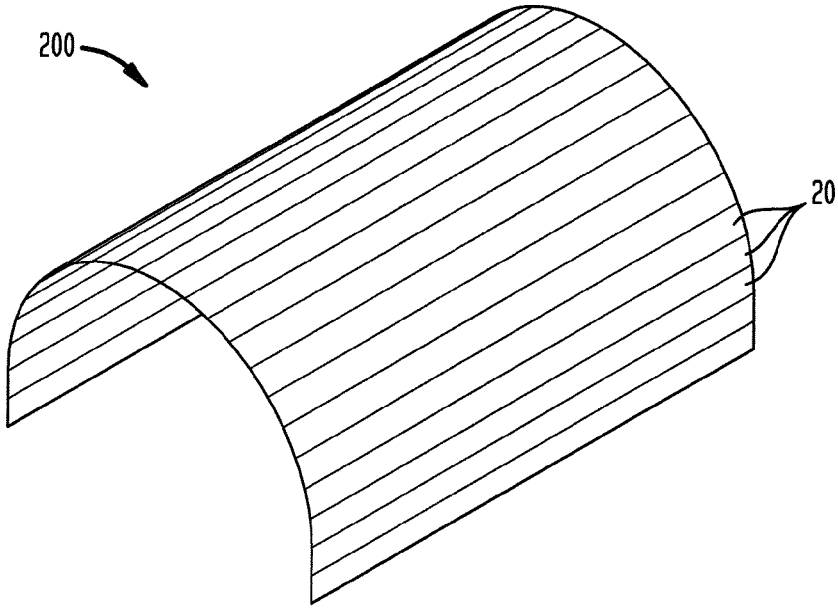
FIG. 6 illustrates a roll-out sheet forming a free-standing shelter according to a further embodiment of the present invention.

More particularly, as described, supra, the deployed configuration of the roll out sheet 10 can be curved or arched, not merely flat. This can be useful in the applications already described, and more particularly can allow the roll-out sheeting to form a free-standing shelter 200 (see FIG. 6), ranging in size from smaller than or equal to that of a doghouse or a utility shed, to a carport, to conceivably that of a aircraft hanger or larger. Notably, the curvature of the deployed roll-out sheet 10, i.e., the angle of one slat 20 relative to an adjacent slat 20, need not be constant throughout the sheet, but can be altered as the needs of the particular application demand. Other applications of a free-standing structure include a plank for bridging the span between a boat and a dock, which plank can be rolled up to either the dock side or the boat side as convenient.

The present invention has been described herein with reference to certain exemplary and/or preferred embodiments. These embodiments are offered as merely illustrative, and not limiting, on the scope of the invention. Certain other alterations and modifications may be apparent to those skilled in the art in light of the present disclosure, without departing from the spirit or scope of the present invention, which is defined solely with reference to the following appended claims.

The invention claimed is:

1. A roll-out construction material comprising:

a plurality of slats, each having a body, a ledge extending from a first lateral end of the body and a shelf extending from a second lateral end opposite the first lateral end, the body comprising a top surface and a bottom surface, the ledge comprising a first upper surface and a first lower surface, the shelf comprising a second upper surface and a second lower surface, wherein the first upper surface of the ledge is substantially flush with the top surface of the body and the second lower surface of the shelf is substantially flush with the bottom surface of the body, and wherein, during the deployment of the construction material, two adjacent slats are aligned with one another such that the first lower surface of the ledge of one of the slats overlies the second upper surface of the shelf of the other of the slats; and a flexible load-bearing film secured to the plurality of slats on one side thereof, the opposite sides of the slats from the flexible film being free whereby the slats articulate relative to one another, wherein the plurality of slats are configured and dimensioned such that the roll-out material can be rolled into a substantially cylindrical shape prior to deployment of the roll-out material, wherein at least one slat comprises an opening at least partially therethrough along a longitudinal axis transverse to a lateral axis joining the first lateral end and the second lateral end; and wherein the material further comprises a support disposed within the opening, the support comprising a first portion extending along a direction from the top surface to the bottom surface of the slat and a second portion substantially parallel to the bottom surface of the slat.

2. The construction material according to claim 1, wherein certain of the slats are arranged side by side along a longitudinal axis transverse to a lateral axis joining the first lateral end and the second lateral end, with the junction of any two slats along the longitudinal axis arranged at an intermediate point along the length of a laterally adjacent slat.

3. The construction material according to claim 1, wherein the opening is filled with a filler.

4. The construction material according to claim 3, wherein the filler is load bearing.

5. The construction material according to claim 3, wherein the filler material provides insulation against one or more of heat and sound.

6. The construction material according to claim 1, wherein the rib or support is a support, the support being integrally formed with one side wall and bracing against the opposite side wall.

7. The construction material according to claim 1, further comprising a securing tab extending outward from at least one slat.

8. The construction material according to claim 7, wherein the securing tab has a through opening.

9. The construction material according to claim 1, wherein the first lower surface of the ledge of a slat interfaces with the second upper surface of the shelf of an adjacent slat to hold the roll-out construction material in flat deployed configuration.

10. The construction material according to claim 1, wherein the load-bearing flexible film comprises a biaxial nylon film.

11. The construction material according to claim 1, wherein the load-bearing flexible film is self-sealing against punctures.

12. The construction material according to claim 1, wherein the slats comprise one or more of plastic, metal, and wood material.

13. The construction material according to claim 1, wherein each of said two adjacent slats comprises a through hole, the two through holes aligned with one another.

14. The construction material according to claim 13, further comprising a securing line passing through the through holes for applying compression to the slats by tensioning the securing line.

15. The construction material according to claim 1, wherein the ledge has a first height defined from the first upper surface to the first lower surface and the shelf has a second height defined from the second upper surface to the second lower surface, the first height being equal to the second height.

16. The construction material according to claim 15, wherein the ledge comprises a first width defined from the first lateral end of the ledge to the second lateral end of the ledge and the shelf has a second width defined from the first lateral end of the shelf to the second lateral end of the shelf, the first width being equal to the second width.

* * * * *